US007115017B1

(12) United States Patent
Laursen et al.

(10) Patent No.: US 7,115,017 B1
(45) Date of Patent: Oct. 3, 2006

(54) METHODS FOR CONTROLLING THE PRESSURES OF ADJUSTABLE PRESSURE ZONES OF A WORK PIECE CARRIER DURING CHEMICAL MECHANICAL PLANARIZATION

(75) Inventors: Thomas Laursen, New Haven, CT (US); Justin Quarantello, Higley, AZ (US); Thomas Stotts, Chandler, AZ (US); Paul Franzen, Gilbert, AZ (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 11/394,516

(22) Filed: Mar. 31, 2006

(51) Int. Cl.
*B24B 49/12* (2006.01)

(52) U.S. Cl. ..... 451/5; 451/41; 451/287

(58) Field of Classification Search ..... 451/5, 451/6, 8, 41, 285–290; 438/16
See application file for complete search history.

(56) References Cited

U.S. PATENT DOCUMENTS

| | | | | |
|---|---|---|---|---|
| 5,433,651 | A * | 7/1995 | Lustig et al. | 451/6 |
| 5,461,007 | A * | 10/1995 | Kobayashi | 438/16 |
| 5,609,511 | A * | 3/1997 | Moriyama et al. | 451/5 |
| 5,700,180 | A * | 12/1997 | Sandhu et al. | 451/5 |
| 5,838,447 | A * | 11/1998 | Hiyama et al. | 356/600 |
| 5,882,243 | A | 3/1999 | Das et al. | |
| 5,916,016 | A | 6/1999 | Bothra | |
| 5,941,758 | A | 8/1999 | Mack | |
| 5,964,653 | A | 10/1999 | Perlov et al. | |
| 6,106,662 | A * | 8/2000 | Bibby et al. | 156/345.13 |
| 6,390,905 | B1 | 5/2002 | Korovin et al. | |
| 6,468,131 | B1 | 10/2002 | Korovin | |
| 6,508,694 | B1 | 1/2003 | Korovin | |
| 6,602,724 | B1 | 8/2003 | Redeker et al. | |
| 6,612,903 | B1 | 9/2003 | Korovin et al. | |
| 6,659,850 | B1 | 12/2003 | Korovin et al. | |
| 6,746,318 | B1 | 6/2004 | Mallery et al. | |
| 6,776,692 | B1 | 8/2004 | Zuniga et al. | |
| 6,923,711 | B1 | 8/2005 | Laursen et al. | |
| 6,960,115 | B1 | 11/2005 | Weldon et al. | |
| 6,991,514 | B1 | 1/2006 | Meloni et al. | |
| 6,991,516 | B1 | 1/2006 | David et al. | |
| 2004/0067717 | A1 | 4/2004 | Korovin et al. | |
| 2004/0259476 | A1 | 12/2004 | Korovin et al. | |
| 2005/0070205 | A1 | 3/2005 | Korovin et al. | |

* cited by examiner

*Primary Examiner*—Lee D. Wilson
*Assistant Examiner*—Anthony Ojini
(74) *Attorney, Agent, or Firm*—Ingrassia Fisher & Lorenz, P.C.

(57) ABSTRACT

Methods are provided for controlling adjustable pressure zones of a CMP carrier. A method comprises determining a first thickness of a layer on a wafer underlying a first zone of the carrier. A first portion of the layer underlying the first zone is removed. The first zone is configured to exert a first pressure against the second surface of the wafer. A second thickness of the layer underlying the first zone is determined and a target thickness corresponding to a predetermined thickness profile is selected. A second pressure for the first zone is calculated using the first thickness, the second thickness, the first pressure, and the target thickness. The pressure exerted by the first zone against the second surface of the wafer is adjusted to the second pressure and the steps are repeated for a second zone.

21 Claims, 4 Drawing Sheets

METHODS FOR CONTROLLING THE PRESSURES OF ADJUSTABLE PRESSURE ZONES OF A WORK PIECE CARRIER DURING CHEMICAL MECHANICAL PLANARIZATION

FIELD OF THE INVENTION

The present invention generally relates to chemical mechanical planarization, and more particularly relates to methods for adjusting the pressures of adjustable pressure zones of a work piece carrier during chemical mechanical planarization.

BACKGROUND OF THE INVENTION

The manufacture of many types of work pieces requires the substantial planarization of at least one surface of the work piece. Examples of such work pieces that require a planar surface include semiconductor wafers, optical blanks, memory disks, and the like. Without loss of generality, but for ease of description and understanding, the following description of the invention will focus on applications to only one specific type of work piece, namely a semiconductor wafer. The invention, however, is not to be interpreted as being applicable only to semiconductor wafers.

One commonly used technique for planarizing the surface of a work piece is the chemical mechanical planarization (CMP) process. In the CMP process a work piece, held by a work piece carrier, is pressed against a polishing surface in the presence of a polishing slurry, and relative motion (rotational, orbital, linear, or a combination of these) between the work piece and the polishing surface is initiated. The mechanical abrasion of the work piece surface combined with the chemical interaction of the slurry with the material on the work piece surface ideally produces a planar surface.

The construction of the carrier and the relative motion between the polishing pad and the carrier head have been extensively engineered in an attempt to achieve a uniform removal of material across the surface of the work piece and hence to achieve the desired planar surface. For example, the carrier may include a flexible membrane or membranes that contacts the back or unpolished surface of the work piece and accommodates variations in that surface. One or more pressure zones or chambers (separated by pressure barriers) may be provided behind the membrane(s) so that different pressures can be applied to various locations on the back surface of the work piece to cause uniform polishing across the front surface of the work piece.

However, the pressure distribution across the back surface of the wafer for conventional carriers often is not sufficiently controllable during the CMP process. Thus, as illustrated in FIG. 1, a work piece with an initial non-planar profile, such as a profile 10, that is planarized by a conventional carrier will have a non-planar surface profile similar to a profile 12 after the CMP process, although a substantially planar surface is desired. Further, conventional carriers do not provide sufficient control of the pressure zones to permit a desired non-planar profile to be achieved. In addition, to the extent the planarization process can be adjusted during CMP, such as, for example, by increasing or decreasing pressures in the adjustable pressure zones, the adjustment(s) typically takes place toward the end of the CMP process, thus resulting in over-correction.

Accordingly, it is desirable to provide a method for controlling the pressures of adjustable pressure zones of a work piece carrier during CMP to achieve substantially planar, or desired non-planar, profiles. In addition, it is desirable to provide a method for controlling the CMP process sufficiently early in the process to prevent over-correction. Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
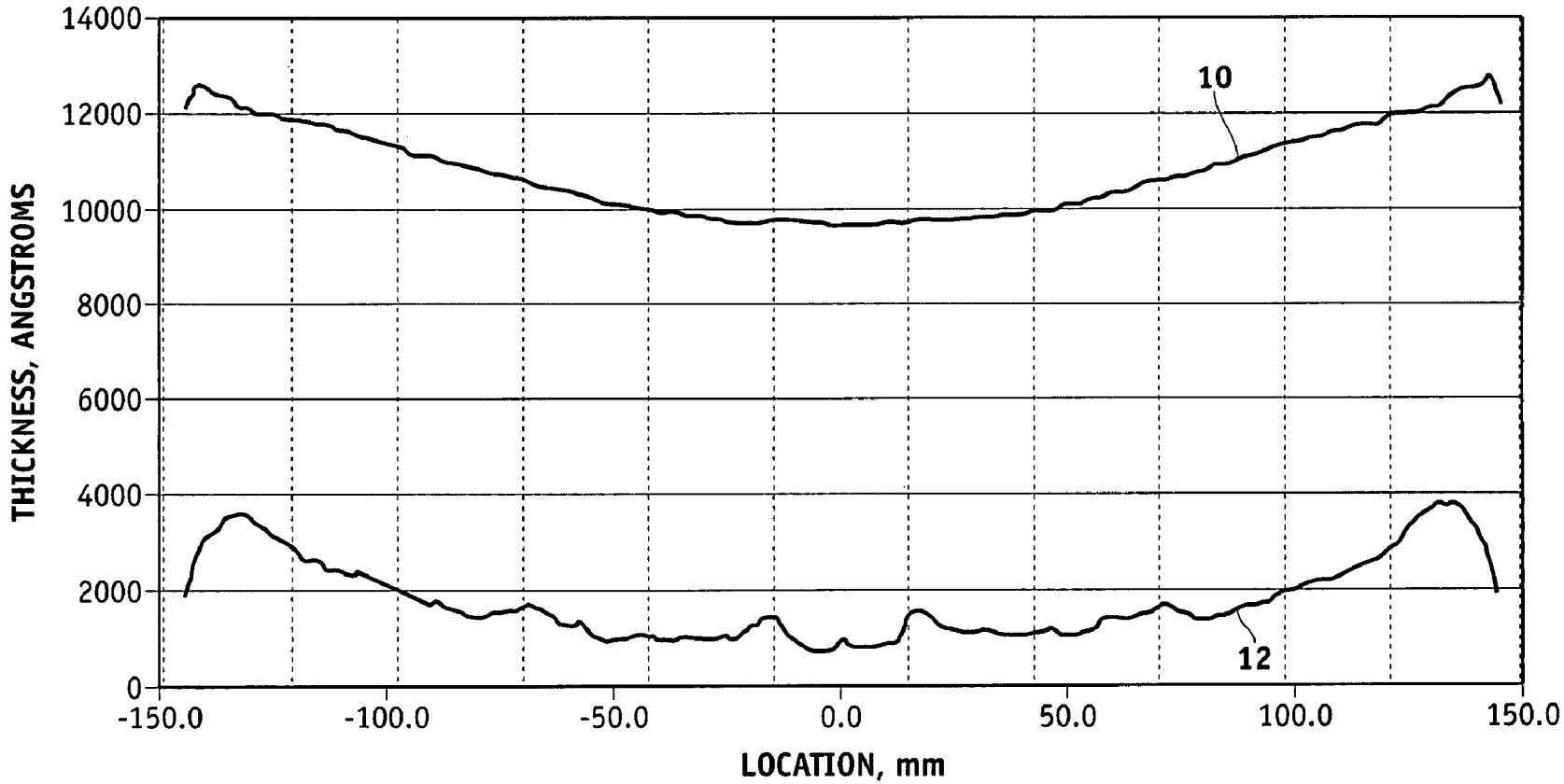
FIG. 1 (PRIOR ART)
FIG. 1 illustrates a four-point probe diameter scan of a semiconductor wafer before and after a CMP process conducted in accordance with the prior art.
Figure 2:
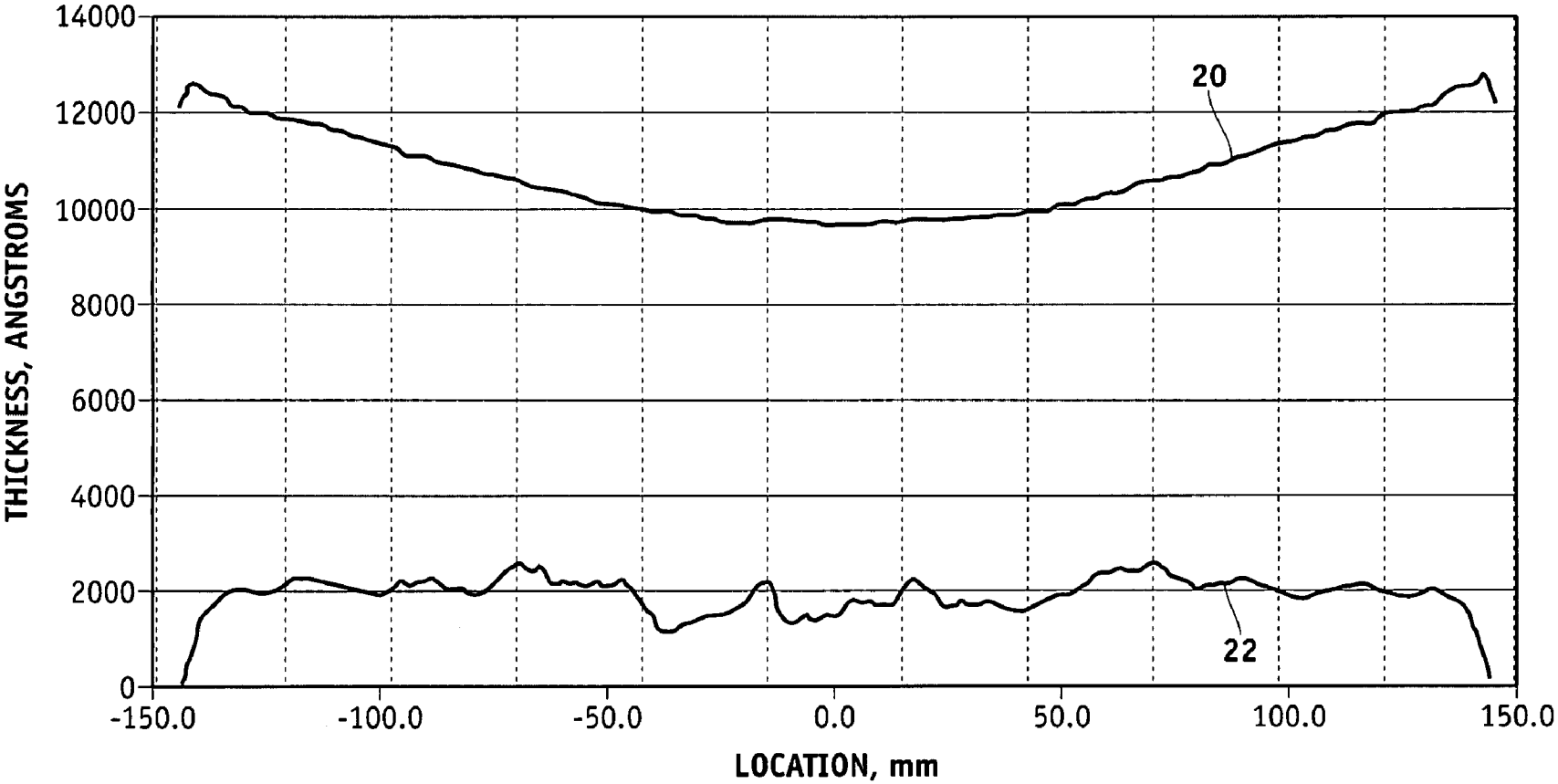
FIG. 2 illustrates a four-point probe diameter scan of a semiconductor wafer before and after a CMP process conducted in accordance with an exemplary embodiment of the present invention.

The present invention is directed to methods for adjusting and controlling the various pressures of multi-zone or multi-chamber work piece carriers during chemical mechanical planarization (CMP) of a work piece. The methods utilize closed-loop control of the planarization of a surface of the work piece via a thickness measuring system of the CMP apparatus. The methods provide a substantially planar profile to be achieved sufficiently early in the CMP process so that over-correction at the end of the CMP process can be avoided. Accordingly, a work piece having an initial non-planar profile, such as profile 20 illustrated in FIG. 2, will exhibit a substantially planar profile 22 having a substantially uniform thickness after a CMP process that utilizes an embodiment of the present inventions. In addition, various embodiments of the present invention permit the achievement of a target non-planar profile of the work piece surface.

The term "chemical mechanical planarization" is often referred to in the industry as "chemical mechanical polishing," and it is intended to encompass herein both terms by the use of "chemical mechanical planarization" and to represent each by the acronym "CMP". For purposes of illustration only, the invention will be described as it applies to a CMP apparatus and to a CMP process and specifically as it applies to the CMP processing of a semiconductor wafer. It is not intended, however, that the invention be limited to these illustrative embodiments; instead, the invention is applicable to a variety of processing apparatus and to the processing and handling of many types of work pieces.

Figure 3:
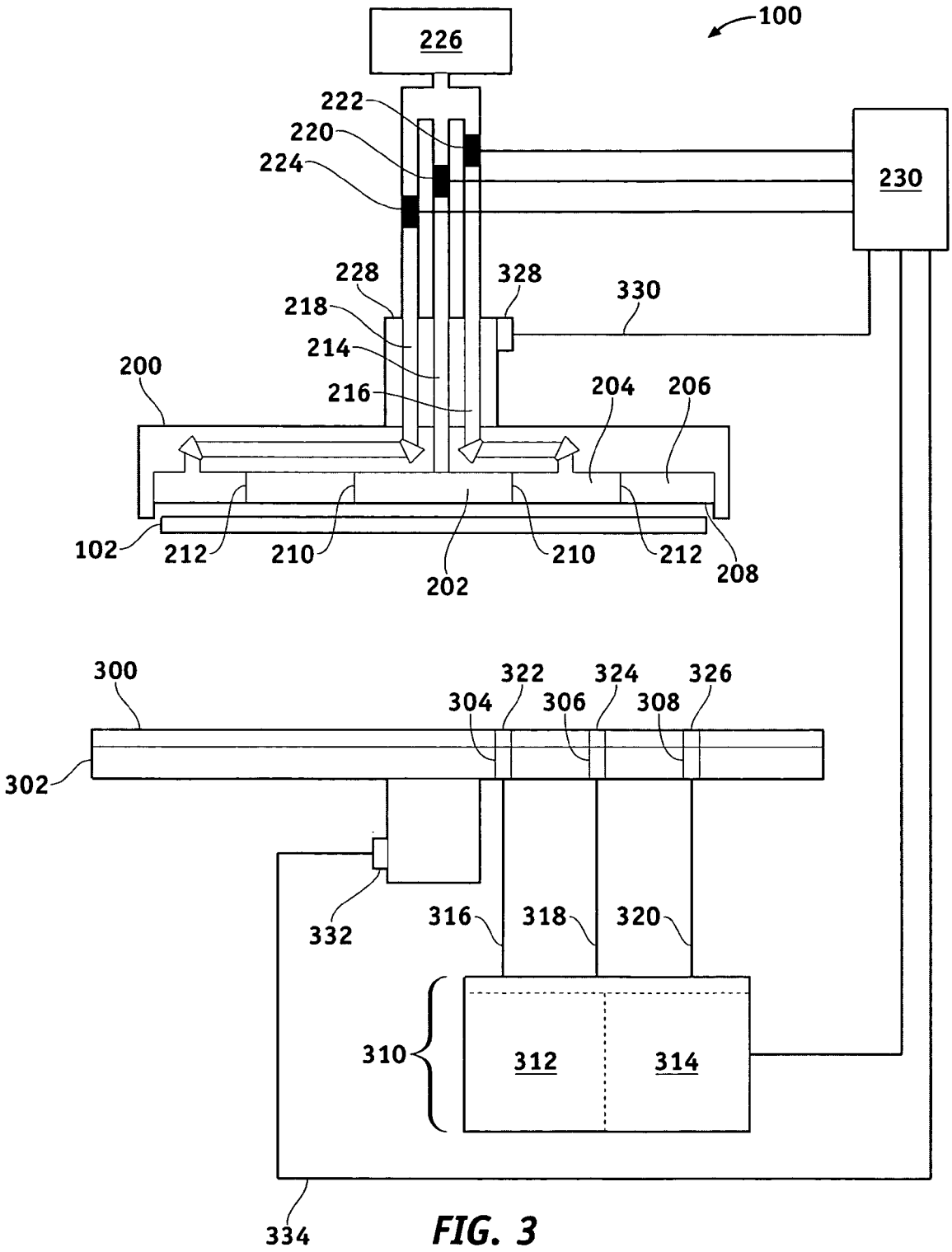
FIG. 3 (PRIOR ART)
FIG. 3 is a cross-sectional view of a CMP apparatus having adjustable pressure zones in accordance with the prior art.

An example of a work piece carrier of a CMP apparatus 100 having multiple pressure chambers or zones (hereinafter "zones") is illustrated in FIG. 3. Examples of other CMP apparatus with carriers having adjustable pressure zones are illustrated in U.S. Pat. No. 6,960,115 B2, issued on Nov. 1, 2005 to Weldon et al., U.S. Pat. No. 6,659,850, issued Dec. 9, 2003 to Korovin et al., U.S. Pat. No. 5,964,653, issued Oct. 12, 1999 to Perlov et al., U.S. Pat. No. 5,941,758, issued Aug. 24, 1999 to Kenneth Mack, U.S. Pat. No. 5,916,016, issued Jun. 29, 1999 to Subhas Bothra, and U.S. Pat. No. 5,882,243, issued Mar. 16, 1999 to Das et al.

Figure 4:
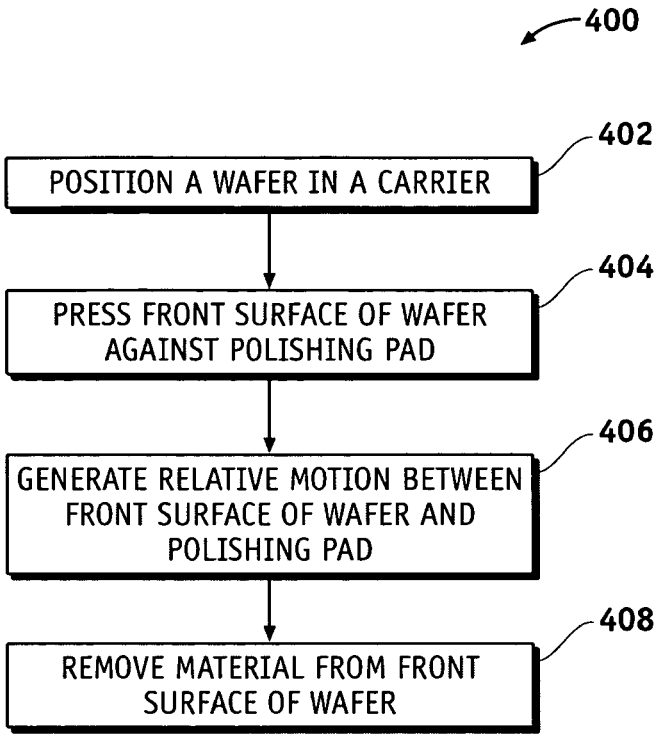
FIG. 4 (PRIOR ART)
FIG. 4 is a flow chart of a method for performing CMP in accordance with the prior art.

A method 400 for performing a conventional CMP process is illustrated in FIG. 4. Referring to FIGS. 3 and 4, during a CMP process, a wafer 102 is positioned within a carrier 200 adjacent and substantially parallel to a working surface or polishing pad 300 (step 402). The front surface of the wafer 102 is pressed against the polishing pad 300 fixed to a supporting surface 302, preferably in the presence of a polishing solution or slurry (not shown) (step 404). The front surface of the wafer 102 is planarized by generating relative motion between the front surface of the wafer 102 and the polishing pad 300 (step 406) thereby removing material from the front surface of the wafer 102 (step 408).

The supporting surface 302 and polishing pad 300 may be moved rotationally, linearly, or preferably, orbitally. Orbital speeds of about 400 to 1000 rpm have been found to produce satisfactory planarization results while permitting measurements of the thickness of the material layers on the surface of the wafer to be taken. The carrier 200 is preferably rotated about its central axis as it presses the front surface of the wafer 102 against the polishing pad 300 during the planarization process. The carrier 200 may also be moved along the polishing pad 300 to enhance the planarization process of the wafer.

The CMP apparatus 100 also utilizes a plurality of probes 304, 306, and 308 positioned beneath the polishing pad 300. Probes 304, 306, 308 may be sensor devices of any suitable multi-probe thickness-measuring system 310. For example, in one exemplary embodiment of the invention, if the layer to be removed from the work piece is a metal layer, probes 304, 306, 308 may be eddy current probes of an eddy current thickness-measuring system, which systems are well known in the art. In another exemplary embodiment of the invention, if the layer to be removed from the work piece is a dielectric layer or other transparent material layer, probes 304, 306, 308 may be optical probes of an optical thickness-measuring system, which systems also are well known in the art. While three probes 304, 306, 308 are illustrated in FIG. 3, any suitable number of probes may be used. The greater the number of probes, the more complete scan of the wafer surface may generally be taken. Each probe 304, 306, 308 may be positioned to collect data points from a particular annular band on the front surface of the wafer. If an orbital CMP tool is used, each probe 304, 306, 308 may be used to monitor a single annular band. The annular bands in such an orbital CMP tool may be made to overlap to ensure the entire front surface of the wafer 102 is being monitored.

The multiprobe thickness-measuring system 310 may include probes, i.e., 304, 306, and 308, a drive system 312 to induce eddy currents in a metal layer on the wafer 102 or to transmit light to a dielectric layer on wafer 102, and a sensing system 314 to detect eddy currents induced in the metal layer by the drive system or to receive reflected light from the dielectric layer. Probes 304, 306, and 308 are activated by drive system 312 through cables 316, 318, 320, respectively. Eddy currents generated by a metal layer on the surface of the wafer 102 or reflected light from a dielectric layer are sensed by the probes and signals are sent to the sensing system through cables 316, 318, 320. The sensing system is coupled to a controller 230, which calculates the thickness of the layer on the wafer 102 and determines locations of the thickness measurements. Eddy currents are transmitted and received, or light is transmitted and received, through holes or transparent areas 322, 324, and 326 within the polishing pad 300.

The carrier 200 illustrated in FIG. 3 has three concentric zones: a central zone 202, an intermediate zone 204, and a peripheral zone 206. A flexible membrane 208 provides a surface for supporting the wafer 102 while an inner ring 210 and an outer ring 212 provide barriers for separating the zones 202, 204, and 206. While three zones 202, 204, and 206 are illustrated in FIG. 3, any suitable number of zones may be used. The greater the number of zones, the more control over the planarization of the wafer surface may be exercised.

The carrier 200 is adapted to permit biasing the pressure exerted on different areas of the back surface of the wafer 102 by the zones. Areas on the back surface of the wafer 102 receiving a higher (or lower) pressure will typically increase (or decrease) the removal rate of material from corresponding areas on the front surface of the wafer 102. Removal rates of material from planarization processes are typically substantially uniform within concentric annular bands about the center of the wafer, but the carrier 200 is preferably capable of exerting different pressures in a plurality of different areas while maintaining a uniform pressure within each area. In addition, the carrier 200 also is able to apply different pressures over different zones on the back surface of the wafer.

The pressure within the central 202, intermediate 204, and peripheral 206 zones may be individually communicated through passageways 214, 216, 218 by respective controllable pressure regulators 220, 222, 224 connected to a pump 226. A rotary union 228 may be used in communicating the pressure from the pump 226 and pressure regulators 220, 222, 224 to their respective zones 202, 204, 206 if the carrier 200 is rotated. Controller 230 may be used to automate the selected pressure for each pressure regulator 220, 222, 224. Thus, each concentric zone 202, 204, 206 may be individually pressurized to create three concentric bands to press against the back surface of the wafer 102. Each zone 202, 204, 206 may therefore have a different pressure, but each concentric band will therefore have a uniform pressure within the band to press against the back surface of the wafer 102. The multiprobe thickness-measuring system 310 is used to determine areas on the front surface of the wafer 102 that need an increase or decrease in material removal rate and, hence, an increase or decrease in pressures of the corresponding zones.

Various devices may be used to track the location of the measurements on the front surface of the wafer 102. For example, an encoder 328 may be used to track the position of the carrier 200 (and thus the wafer) and transmit this information via communication line 330 to the controller 230. In a similar manner, an encoder 332 may be used to track the position of the supporting surface 302 (and thus the probes) and transmit this information via communication line 334 to the controller 230. The controller 230 thus has the information necessary to match the data from the multiprobe thickness-measuring system 310 with the data's corresponding location on the front surface of the wafer 102. Once the controller 230 has determined the thickness of the material layer to be thinned or removed from the surface of wafer 102 and the location, that is, the zone 202, 204, or 206, of the carrier corresponding to the location of the wafer from which the measurement was taken, the controller 230 can determine if any adjustments to the pressures within the zones need to be made to achieve a target planar or non-planar profile.

Figure 5:
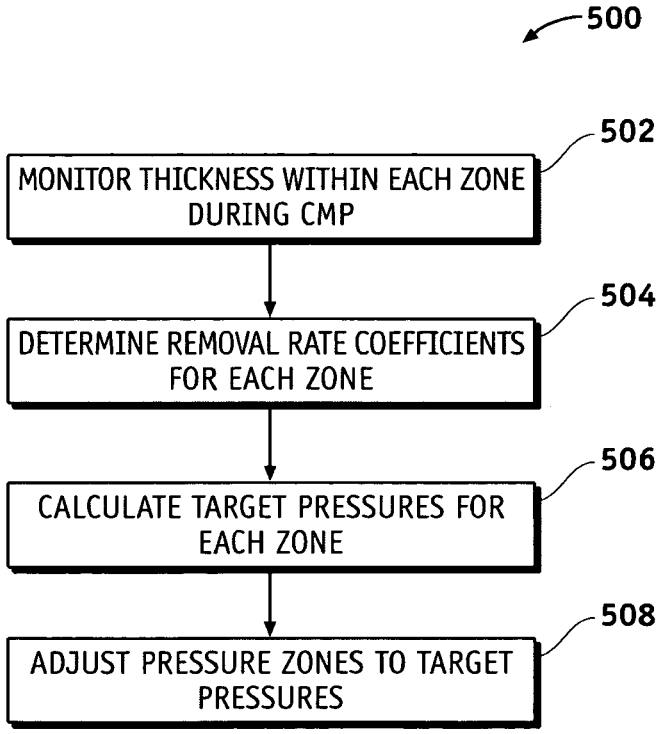
FIG. 5 is a flow chart of a method for controlling the adjustable pressure zones of a work piece carrier during CMP in accordance with an exemplary embodiment of the present invention.

Referring to FIG. 5, various exemplary embodiments of a closed-loop control method 500 for controlling the pressures of the adjustable pressure zones of a work piece carrier will now be described. The method may be performed by the controller 230 of the CMP apparatus 100, which in turn can serve to adjust the pressures within one or more of the pressure zones 202, 204, 206 via regulators 220, 222, 224. The pressure within each zone can be controlled and adjusted using the method so that a substantially planar profile or, if desired, a non-planar profile across the front surface of the wafer may be achieved. During the planarization process, a multiprobe thickness-measuring system, such as an in-situ eddy current system or in-situ optical system, that can assess the thickness of the material layer to be thinned or removed from the surface of a wafer, monitors throughout the planarization process the thickness profile of the layer within each of the zones (step 502). After planarization for a pre-determined time interval, the closed-loop control system determines removal rate coefficients for each of the zones (step 504). The removal rate coefficients are calculated using thickness measurements taken along the diameter of the wafer within each of the pressure zones by the in-situ multiprobe thickness-measuring system (or, alternatively, by a four-point probe). Target pressures of the zones necessary to achieve the desired profile of the layer then are calculated using the removal rate coefficients and the present pressures of the zones (step 506). The carrier's pressure zones are adjusted to the target pressures (step 508), thereby providing removal profile control. The method is repeated until the layer is thinned to the target thickness, at which point the CMP process may continue at equilibrium until the material layer is substantially removed from the wafer.

In an exemplary embodiment of the invention, the new or target pressure exerted by a zone can be determined by projecting a target thickness of the material layer within that zone. If a substantially planar profile is desired, the target thickness may be selected as the thickness of the zone at which a substantially planar surface across the wafer is to be first realized. Alternatively, if a non-planar profile is desired, the target thickness within the zone may be selected as the thickness corresponding to the desired non-planar profile at which the desired non-planar profile is to be first realized. By selecting a target thickness within the zone, which thickness is realized before substantial removal of the material layer, adjustments to the planarization process can be made sufficiently early so that over-correction at the end of the CMP process can be avoided. The projected target thickness $T_{z,n+1}$ within a zone z at a polish time $t_{n+1}$ can be expressed as:

$$T_{z,n+1}=T_{z,n}-R_{z,n+1} \quad (1),$$

where $T_{z,n}$ is the thickness of the material layer within zone z at polish time $t_n$, $R_{z,n+1}$ is the projected thickness removed from the material layer within zone z at polish time $t_{n+1}$, z ranges from 1 to $Z_f$, where $Z_f$ is the total number of zones, n is an integer from 1 to N, where N is the final number of times pressure adjustments are made, and $t_0$ is the start time for the CMP process. The time interval $(t_{n+1}-t_n)$ may be of any suitable length of time but preferably are in the range of about 5 seconds to about 100 seconds.

Allowing for non-linear Prestonian behavior, the removal rate RR of the material layer can be expressed using Preston's Equation as follows:

$$RR_z=kP_z^xV_z, \quad (2)$$

where $P_z$ is the pressure exerted by zone z, $V_z$ is the linear speed of the work piece carrier, k is a Preston coefficient that represents the contact conditions at the pad-wafer interface, and x is a Preston-correction exponent that takes into account a non-linear pressure response. By keeping the linear speed of the work piece carrier constant across the wafer, k and x can be determined experimentally from equation (2).

The ratio of the removal rates within zone z throughout the time intervals from from $t_{n-1}$ to $t_n$ and from $t_n$ to $t_{n+1}$ and, hence, the ratio of the pressures exerted by zone z throughout the time interval from $t_n$ to $t_{n+1}$ and from $t_{n-1}$ to $t_n$ can be expressed as follows:

$$\frac{R_{z,n+1}(t_n-t_{n-1})}{R_{z,n}(t_{n+1}-t_n)}=\frac{P_{z,n+1}^x}{P_{z,n}^x}=C_{z,n+1}, \quad (3)$$

where $C_{z,n+1}$ is the removal rate coefficient or, alternatively, the pressure coefficient.

Accordingly, combining equations (1) and (3), the projected target thickness may be expressed according to equation (4):

$$T_{z,n+1}=T_{z,n}-C_{z,n+1}R_{z,n}(t_{n+1}-t_n)/(t_n-t_{n-1}) \quad (4).$$

In one embodiment of the invention, removal rates across the entire surface of the wafer are kept substantially constant by the controller throughout the CMP process. Accordingly, the removal rate across the wafer during the time interval $(t_{n+1}-t_n)$ is equal to the removal rate across the wafer during the time interval $(t_n-t_{n-1})$, that is:

$$\frac{\rho_{n+1}}{t_{n+1}-t_n}=\frac{\rho_n}{t_n-t_{n-1}}, \quad (5)$$

where ρ is a weighted average of the amount of material removed from the material layer across all the zones. The weighted average may be defined by $\rho=\Sigma W_zR_z$, where $W_z$ is any suitable weighting factor and $1=\Sigma W_z$. An example of suitable weighting factors includes:

$W_z=M_z/\Sigma M_z$, where $M_z$ is the number of measurement points from zone z and $\Sigma M_z$ is the total number of measurement points across all zones. Another example of a suitable weighting factor includes:

$W_z=M_z(D_z^2-D_{z-1}^2)/D_F^2\Sigma M_z)$, where $M_z$ is the number of measurement points from zone z, $D_z$ is the outer diameter or radius of the zone z, $D_F$ is the outer diameter or radius of the final zone $Z_F$, and $\Sigma M_z$ is the total number of measurement points across all zones.

Equation (5) can be rearranged to the following:

$$t_{n+1}-t_n=\rho_{n+1}(t_n-t_{n-1})/\rho_n \quad (6)$$

By defining $\tau_n$ as the weighted average thickness of the material layer across the work piece at time $t_n$, equation (6) may be rewritten as follows:

$$t_{n+1}-t_n=(\tau_n-\tau_{n+1})(t_n-t_{n-1})/(\tau_{n-1}-\tau_n) \quad (7)$$

By using equation (7) in equation (4), the projected target thickness in zone z can be expressed as:

$$T_{z,n+1}=T_{z,n}-C_{z,n+1}R_{z,n}(\tau_n-\tau_{n+1})/(\tau_{n-1}-\tau_n) \quad (8)$$

The removal rate coefficient then can be expressed as:

$$C_{z,n+1}=\frac{(T_{z,n}-T_{z,n+1})(\tau_{n-1}-\tau_n)}{R_{z,n}(\tau_n-\tau_{n+1})}. \quad (9)$$

In turn, the removal $R_{z,n}$ at time $t_n$ within a zone z is equal to the thickness $T_{z,n}$ at time $t_n$ minus the previous thickness $T_{z,n-1}$ within zone z. Thus, equation (9) can be expressed as:

$$C_{z,n+1}=\frac{(T_{z,n}-T_{z,n+1})(\tau_{n-1}-\tau_n)}{(T_{z,n-1}-T_{z,n})(\tau_n-\tau_{n+1})}. \quad (10)$$

From the $T_{z,n+1}$ values of the various zones, a target weighted average thickness $\tau_{n+1}$ can be calculated. If a substantially planar thickness profile is desired, $T_{z,n+1}$ will be the same for all zones and $T_{z,n+1}$ will be equal to $\tau_{n+1}$. The target weighted average thickness $\tau_{n+1}$ of the material layer across the wafer can be defined as the weighted average thickness $\tau_n$ of the material layer at time $t_n$ minus a selected target removal amount $\Delta$, or:

$$\tau_{n+1}=\tau_n-\Delta \quad (11).$$

The greater the value selected for $\Delta$, the more aggressive the planarization process can be and the sooner the desired profile can be achieved. Selected target removal deviations from the target removal amount $\Delta$ within zone z can be expressed as $\delta_z$, where $\delta_z \leqq \Delta$. Thus, the target thickness $T_{z,n+1}$ for zone z can be defined as the target weighted average thickness $\tau_{n+1}$ of the material layer across the wafer plus the target removal deviation $\delta_z$ for zone z, or:

$$T_{z,n+l}=\tau_{n+1}+\delta_z \quad (12).$$

Equations (11) and (12) can be combined as follows:

$$T_{z,n+1}=\tau_n-\Delta+\delta_z \quad (13).$$

The target weighted average thickness $\tau_{n+1}$ of the material layer across the wafer can be expressed as:

$$\tau_{n+1}=\Sigma W_z T_{z,n+1}=\tau_n-\Delta+\Sigma W_z\delta_z \quad (14),$$

where $\Sigma W_z\delta_z<\Delta$.

By combining equation (14) and equation (10), the removal rate coefficient can be expressed according to equation (15):

$$C_{z,n+1}=\frac{(T_{z,n}-\tau_n+\Delta-\delta_z)(\tau_{n-1}-\tau_n)}{(\Delta-\sum W_z\delta_z)(T_{z,n-1}-T_{z,n})}, \quad (15)$$

where the term $(T_{z,n}-\tau_n+\Delta-\delta_z)>0$.

Accordingly, as $\Delta$ and $\delta_z$ are assigned values, and the remaining terms can be measured by the multiprobe thickness-measuring system or determined from measurements taken by the multiprobe thickness-measuring system, the removal rate coefficient $C_{z,n+1}$ can be determined and the new pressure within zone z can be calculated from equation (3):

$$P_{z,n+1}=P_{z,n}C_{z,n+1}^{(1/x)} \quad (16).$$

Upon calculation of $P_{z,n+1}$, the controller can activate the corresponding pressure regulator so that the previous pressure $P_{z,n}$ of zone z can be changed to $P_{z,n+1}$ to change the amount of material removed from the material layer within zone z during a subsequent CMP time interval. After the new pressures are calculated for all zones, the CMP process can be continued using the new pressures. The method then can be repeated as necessary until the thickness of the material layer within each zone has reached the selected target thicknesses of the target profile. At this point, a substantially planar profile, or a desired non-planar profile, is realized. If desired, the CMP process may continue with equal pressures across all zones until the material layer is substantially removed.

In another exemplary embodiment of the present invention, the controller keeps a weighted average pressure exerted on the wafer constant, instead of keeping the removal rates constant. In this regard, the new pressure $P_{z,n+1}$ can be expressed using the following equation:

$$\frac{P_{z,n+1}}{P_{z,n}}=\frac{\Phi_0}{\Phi_n}C_{z,n+1}^{1/x}, \quad (16)$$

where $\Phi_n=\Sigma W_z P_{z,n}$ and $\Phi_0=\Sigma W_z P_{z,0}$. The ratio $$\frac{\Phi_0}{\Phi_n}$$

is a scaling factor that ensures that the weighted average pressure is kept constant.

In further exemplary embodiment of the present invention, a method that provides for moderate pressure control and variation uses simplified expressions of equations (10) and (16) set forth above. In this regard, the target thickness $T_{z,n+1}$ of the material layer may be defined as uniform across the wafer. Thus, $T_{z,n+1}$ can be expressed as $T_{n+1}$ and is equal to $\tau_{n+1}$. Accordingly, the removal rate coefficient can be expressed as:

$$C_{z,n+1}=\frac{(T_{z,n}-T_{n+1})(\tau_{n-1}-\tau_n)}{(\tau_n-T_{n+1})(T_{z,n-1}-T_{z,n})}. \quad (18)$$

Accordingly, $T_{n+1}$ is assigned a value, and the remaining terms can be measured by the multiprobe thickness-measuring system or determined from such measured terms. Thus, the removal rate coefficient $C_{z,n+1}$ can be determined and the new pressure within zone z can be calculated from equation (16):

$$P_{z,n+1}=P_{z,n}C_{z,n+1}^{1/x} \quad (16),$$

where a linear response between $P_{z,n+1}$ and $P_{z,n}$ is assumed and x therefore is assigned a value of one (1).

In yet another exemplary embodiment of the present invention, a correction control parameter K may be used to calculate a new pressure within a zone z to optimize the removal of material from the material layer and thus obtain a substantially planar profile. The new pressure $P_{z,n+1}$ within zone z can be expressed using the following equation:

$$P_{z,n}=P_{z,n-1}+K((T_{z,n}-\min(T_{z,n},T_{z+1,n},\ldots))/(R_{z,n}/P_{z,n})) \quad (19),$$

where K is experimentally determined but preferably has a value in the range of about 0 to about 1. The term "min($T_{z,n}$, $T_{z+1,n}$, . . . )" expresses the minimum thickness among all the zones at time $t_n$. By solving for $P_{z,n}$, equation (19) may be rewritten as:

$$P_{z,n}=P_{z,n-1}(1/(1-K(T_{z,n}-\min(T_{z,n},T_{z+1,n},\ldots))/R_{z,n})) \quad (20),$$

where the term $(1/(1-K(T_{z,n}-\min(T_{z,n}, T_{z+1,n}, \ldots))/R_{z,n}))$ is the removal rate coefficient and $R_{z,n}$ is equal to $(T_{z,n-1}-T_{z,n})$. Accordingly, as K has been assigned a value or has been experimentally determined and the remaining terms can be measured by the multiprobe thickness-measuring system or determine from such measured terms, the new pressure within zone z can be calculated from equation (20).

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for removing at least a portion of a material layer from a first surface of a work piece utilizing a CMP apparatus having a work piece carrier with a plurality of pressure adjustable zones, wherein each zone is configured to exert a pressure against a second surface of the work piece during a CMP process, the method comprising the steps of:

determining a first thickness $T_{z,n-1}$ of the material layer underlying a first zone z, where z is an integer from 1 to $Z_f$, $Z_f$ is the total number of zones, n is an integer from 1 to N, and N is the total number of times thickness measurements are assessed;

removing a first portion of the material layer underlying the first zone for a time interval $(t_n-t_{n-1})$ wherein the first zone is configured to exert a first pressure $P_{z,n}$ against the second surface of the work piece;

determining a second thickness $T_{z,n}$ of the material layer underlying the first zone;

selecting a target thickness $T_{z,n+1}$ of the material layer within zone z corresponding to a predetermined thickness profile to be produced before the material layer is substantially removed;

calculating a second pressure $P_{z,n+1}$ using the first pressure $P_{z,n}$, the first thickness $T_{z,n-1}$, the second thickness $T_{z,n}$, and the target thickness $T_{z,n+1}$, wherein the second pressure is to be exerted against the second surface of the work piece by the first zone during removal of a second portion of the material layer;

adjusting the pressure exerted by the first zone against the second surface of the work piece to the second pressure $P_{z,n+1}$; and repeating the foregoing steps for a second zone.

2. The method of claim 1, further comprising the step of removing a second portion of the material layer underlying the first zone, wherein the first zone is configured to exert the second pressure against the second surface of the work piece.

3. The method of claim 1, wherein the step of removing a first portion of the material layer comprises removing said first portion of the material layer using a removal rate that is constant throughout the CMP process.

4. The method of claim 1, wherein the step of removing a first portion of the material layer comprises removing said first portion of the material layer using a weighted average pressure that is constant throughout the CMP process.

5. The method of claim 1, further comprising the steps of determining a first average thickness $\tau_{n-1}$ of the material layer on the first surface of the work piece before the step of removing a first portion of the material layer, and further comprising the step of determining a second average thickness $\tau_n$ of the material layer on the first surface of the work piece before the step of calculating a second pressure $P_{z,n+1}$.

6. The method of claim 5, wherein the step of selecting a target thickness $T_{z,n+1}$ comprises the step of selecting a target average thickness $T_{n+1}$ of the material layer on the first surface of the work piece at which a substantially planar profile is desired, and wherein the step of calculating a second pressure $P_{z,n+1}$ comprises calculating said second pressure using the first thickness $T_{z,n-1}$, the second thickness $T_{z,n}$, the first average thickness $\tau_{n-1}$, the second average thickness $\tau_n$, and the target average thickness $T_{n+1}$.

7. The method of claim 5, further comprising the steps of selecting a target removal amount Δ from the material layer and selecting a target removal deviation $\delta_z$ from the target removal amount Δ underlying the first zone and wherein the step of calculating a second pressure $P_{z,n+1}$ comprises the step of calculating said second pressure using the first thickness $T_{z,n-1}$, the second thickness $T_{z,n}$, the first average thickness $\tau_{n-1}$, the second average thickness $\tau_n$, the target removal amount Δ, and the target removal deviation $\delta_z$.

8. The method of claim 7, wherein the step of calculating a second pressure $P_{z,n+1}$ comprises the step of calculating the second pressure using the equation:

$$P_{z,n+1}=P_{z,n}C_{z,n+1}^{(1/x)},$$

where x is a Preston-correction exponent for zone z, and $C_{z,n+1}$ is a removal coefficient expressed according to the following equation:

$$C_{z,n+1}=\frac{(T_{z,n}-\tau_n+\Delta-\delta_z)(\tau_{n-1}-\tau_n)}{(\Delta-\sum W_z\delta_z)(T_{z,n-1}-T_{z,n})},$$

where Wz is a weighting factor, $\Sigma W_z=1$, and $\Sigma W_z\delta_z<\Delta$.

9. The method of claim 1, wherein the step of measuring a second thickness of the material layer underlying the first zone comprises the step of measuring a second thickness of the material layer underlying each of the zones, and wherein the step of calculating a second pressure $P_{z,n+1}$ comprises the steps of:

comparing the second thicknesses of the material layer of each of the zones and determining a minimum second thickness;

selecting a correction control parameter K; and calculating the second pressure using the minimum thickness, the correction control parameter K, the first thickness $T_{z,n-1}$, and the second thickness $T_{z,n}$.

10. A method for producing a target thickness profile of a material layer on a first surface of a work piece utilizing a CMP apparatus having a work piece carrier with a number $Z_f$ of pressure adjustable zones, wherein each zone is configured to exert a pressure against a second surface of the work piece during a CMP process, the method comprising the steps of:

for each zone, determining a first thickness $T_{z,n-1}$ of the material layer, where z is an integer between 1 and $Z_f$, n is an integer between 1 and N, and N is the total number of times thickness measurements are assessed;

calculating a first average thickness $\tau_{n-1}$ of the material layer across the work piece;

for each zone, removing a first portion of the material layer, wherein each of said zones is configured to exert a first pressure $P_{z,n}$ against the second surface of the work piece;

for each zone, determining a second thickness $T_{z,n}$ of the material layer;

calculating a second average thickness $\tau_n$ of the material layer across the work piece using the second thicknesses;

for each zone, selecting a target thickness $T_{z,n+1}$ corresponding to the target thickness profile of the material layer;

for each zone, calculating a removal rate coefficient $C_{z,n+1}$ using the first thickness $T_{z,n-1}$, the second thickness $T_{z,n}$, the first average thickness $\tau_{n-1}$, the second average thickness $\tau_n$, and the target thickness $T_{z,n+1}$; and for each zone, calculating a second pressure $P_{z,n+1}$ from the first pressure and the removal rate coefficient, wherein the second pressure is to be exerted against the second surface of the work piece within the first zone during removal of a second portion of the material layer.

11. The method of claim 10, wherein the step of removing a first portion of the material layer comprises removing said first portion of the material layer using a removal rate that is constant throughout the CMP process.

12. The method of claim 10, wherein the step of removing a first portion of the material layer comprises removing said first portion of the material layer using a weighted average pressure that is constant throughout the CMP process.

13. The method of claim 10, wherein the step of selecting for each zone a target thickness $T_{z,n+1}$ corresponding to the target thickness profile of the material layer comprises the step of selecting the same target thickness $T_{n+1}$ for each zone, such that $T_{n+1}$ is equal to a target average thickness $\tau_{n+1}$.

14. The method of claim 10, further comprising the step of adjusting the pressure exerted by each zone against the second surface of the work piece to the second pressure $P_{z,n+1}$.

15. The method of claim 10, wherein the step of calculating a second pressure $P_{z,n+1}$ from the first pressure and the removal rate coefficient comprises the step of calculating the second pressure $P_{z,n+1}$ using the equation:

$$P_{z,n+1}=P_{z,n}C_{z,n+1}^{(1/x)},$$

where x is a Preston-correction exponent for zone z.

16. The method of claim 10, wherein the step of calculating a removal rate coefficient $C_{z,n+1}$ for each zone comprises the steps of:

selecting a target removal amount $\Delta$ from the material layer, wherein $\Delta$ may be expressed by the equation $\Delta=\tau_n-\tau_{n+1}$;

selecting a target removal deviation $\delta_z$ from the target removal amount $\Delta$ underlying the first zone, wherein $\delta_z$ can be expressed by the equation $\delta_z=T_{z,n+1}-\tau_{n+1}$; and calculating a removal rate coefficient $C_{z,n+1}$ using the equation:

$$C_{z,n+1}=\frac{(T_{z,n}-\tau_n+\Delta-\delta_z)(\tau_{n-1}-\tau_n)}{(\Delta-\sum W_z\delta_z)(T_{z,n-1}-T_{z,n})},$$

where $W_z$ is a weighting factor, $\Sigma W_z=1$, and $\Sigma W_z\delta_z<\Delta$.

17. A CMP apparatus comprising:

a working surface;

a work piece carrier configured to press a first surface of a work piece against the working surface, wherein the work piece carrier has a plurality of pressure zones, each pressure zone configured to exert a pressure on a second surface of the work piece;

a multi-probe thickness measuring system having a plurality of probes disposed proximate to said working surface, wherein the multi-probe thickness measuring system is configured to measure a thickness of a material layer on the first surface of the work piece; and a controller electrically coupled to the multi-probe thickness measuring system and the work piece carrier, wherein the controller is configured to:

receive first signals from the multi-probe thickness measuring system;

determine a first thickness of the material layer underlying a first pressure zone of the work piece carrier using the first signals;

cause the first zone of the work piece carrier to exert a first pressure against the second surface of the work piece:

cause the working surface to remove a first portion from the material layer underlying the first zone;

receive second signals from the multi-probe thickness measuring system;

determine a second thickness of the material layer underlying the first zone using the second signals;

receive as input a target removal amount projected to be removed from the material layer;

calculate a second pressure from the first pressure, the first thickness, the second thickness, and the target removal amount; and cause the work piece carrier to change the pressure exerted by the first zone against the second surface of the work piece to the second pressure.

18. The CMP apparatus of claim 17, wherein the controller is further configured to cause removal rates for the removal of the material layer across the first surface of the wafer to be kept constant.

19. The CMP apparatus of claim 17, wherein the controller is further configured to cause a weighted average pressure exerted on the second surface of the wafer to be kept constant.

20. The CMP apparatus of claim 17, wherein the multi-probe thickness measuring system is an eddy current thickness measuring system.

21. The CMP apparatus of claim 17, wherein the multi-probe thickness measuring system is an optical thickness measuring system.

* * * * *